US005495725A

United States Patent [19]

Middlemiss

[11] Patent Number: 5,495,725

[45] Date of Patent: Mar. 5, 1996

[54] WATER TRANSFER ASSEMBLY FOR WATER COOLER

[76] Inventor: William Middlemiss, 3935 NW. 38th Ave., Fort Lauderdale, Fla. 33309

[21] Appl. No.: 348,934

[22] Filed: Nov. 25, 1994

[51] Int. Cl.[6] ..... B67D 5/62

[52] U.S. Cl. ..... 62/389; 141/40; 141/198; 222/61; 222/67

[58] Field of Search ..... 62/340, 389; 222/61, 222/67, 394; 141/40, 41, 198

[56] References Cited

U.S. PATENT DOCUMENTS

| | | | |
|---|---|---|---|
| 2,929,535 | 3/1960 | Fairbanks | 222/394 |
| 3,179,292 | 4/1966 | Terry | 222/82 |
| 3,495,612 | 2/1970 | Moreland | 137/209 |
| 3,558,013 | 1/1971 | Ponzo | 222/394 X |
| 3,584,472 | 6/1971 | Sholtes | 62/394 |
| 4,027,499 | 6/1977 | Barto et al. | 62/340 |
| 4,153,181 | 5/1979 | Parker et al. | 222/61 |
| 5,003,790 | 4/1991 | Goupil | 62/389 |

*Primary Examiner*—William E. Tapolcai
*Attorney, Agent, or Firm*—Alvin S. Blum

[57] ABSTRACT

A water transport system replaces the inverted water bottle on a conventional bottled water cooler of the type with a refrigerated, open top water reservoir. The system automatically transfers water from an upright water bottle below the reservoir into the reservoir whenever water in in the reservoir falls below a predetermined level. A water pipe carries water from the bottle, through a sealed closure in the bottle neck and up into the reservoir whenever air pressure in the bottle is elevated. An air pump in a housing atop the reservoir generates air pressure in an air tube passing through the closure and into the bottle. A water level sensor reduces air pressure in the system when the water in the reservoir reaches a predetermined level to thereby automatically control refilling of the reservoir.

8 Claims, 1 Drawing Sheet

WATER TRANSFER ASSEMBLY FOR WATER COOLER

BACKGROUND OF THE INVENTION

This invention relates to bottled water coolers of the type having a refrigerated reservoir with an open top onto which an inverted water bottle is supported and more particularly to a water transfer assembly which fits onto the reservoir in place of the inverted water bottle to automatically maintain a predetermined water level in the reservoir by pumping water from an upright water bottle positioned below the reservoir.

Water coolers of this type generally require the difficult lifting of the 20 Kg. bottle, rapidly inverting it and positioning the neck within the reservoir before all the water spills out. Additionally, one should avoid contaminating the neck, which becomes immersed in the drinking water in the reservoir.

The concept of providing a different cooler without an open top with the water bottle upright below the reservoir and pumping water up to the reservoir is not new, as evidenced by U.S. Pat. Nos. 3,495,612 issued Feb. 17, 1970 to Moreland et al.; 3,179,292 issued Apr. 20, 1965 to Terry and 3,584,472 issued Jun. 15, 1971 to Sholtes.

Although these coolers presented certain advances, they had definite disadvantages, and have not met with substantial success in the decades since their introduction. The open top coolers are most popular. They are relatively trouble free, although the reservoir requires frequent cleaning because of the introduction of foreign matter every time the bottle is replaced.

It would be desirable if a simple device were available to convert these economical and ubiquitous coolers so that they could function automatically without requiring the difficult and awkward lifting and inverting maneuver that has injured so many backs. It would also be desirable if a means could be provided to avoid the opening and contaminating of the reservoir every time a bottle is changed.

SUMMARY OF THE INVENTION

It is accordingly an object of the invention to provide a water transfer assembly for mounting atop a refrigerated reservoir in place of an inverted water bottle that will pump water from an upright water bottle into the reservoir to automatically maintain a predetermined water level. It is a further object that the assembly be installable by simply laying it in place on the reservoir and sealing the bottle with a closure or stopper. It is yet another object that the assembly be economical of manufacture and use so that it may be added to the low cost coolers of the art at very little cost.

The water transfer assembly of the invention comprises a housing arranged to fit on the reservoir. An electric powered air pump within the housing pumps air through a tube into the bottle, passing through a stopper sealing the bottle neck so that pressure builds up in the bottle. Water in the bottle is forced by the air pressure through a water pipe through the stopper, through the housing and out the bottom of the housing into the reservoir. A sensing device below the housing senses the water level and reduces the air pressure when a predetermined water level is reached so that the water level in the reservoir is automatically maintained.

These and other objects, advantages and features of the invention will become apparent when the detailed description is studied in conjunction with the drawings.

DETAILED DESCRIPTION OF PREFERRED EMBODIMENTS

Figure 1:
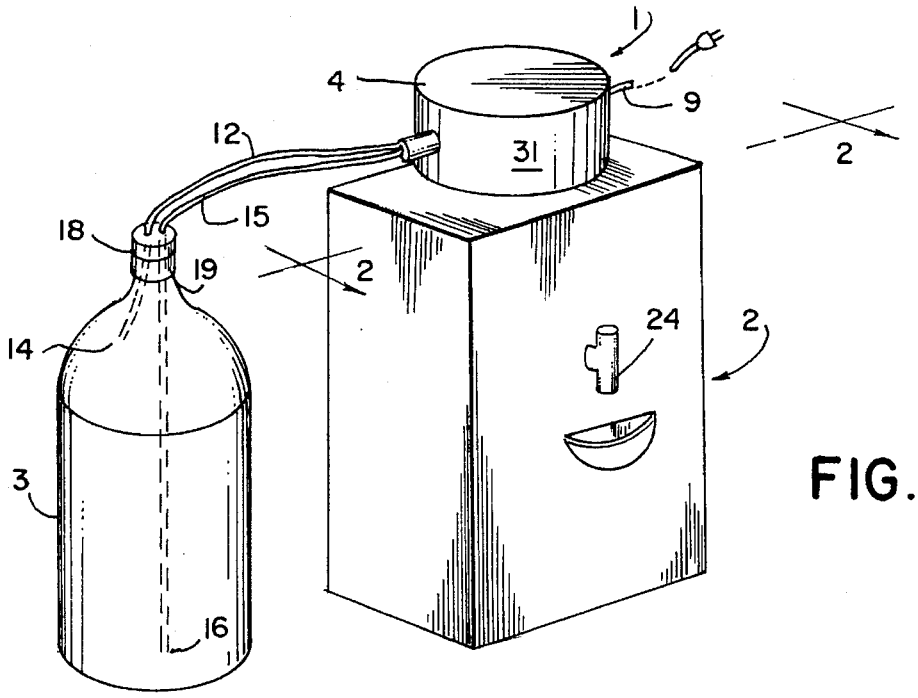
FIG. 1 is a perspective view of the water transfer assembly of the invention in place on a cooler.

In the figures, like elements are given the same reference numeral.

Figure 2:
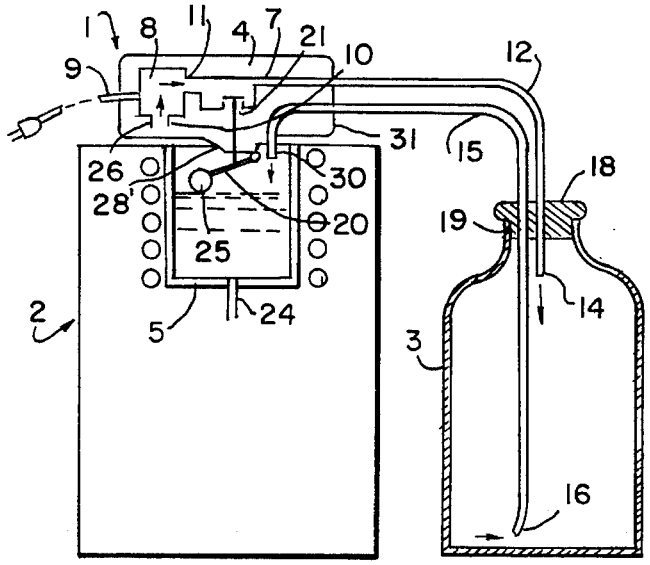
FIG. 2 is a sectional view partially diagrammatic, taken through line 2—2 of FIG. 1.

Referring now first to FIGS. 1 and 2, a conventional water cooler 2, well known in the art, need not be described in detail. It has a refrigerated reservoir 5 with a gravity feed drain 24 and an open top 28 adapted to ordinarily receive an inverted water bottle (not shown). Water spills from the inverted bottle until the neck is submerged and a vacuum builds up in the bottle. Then water only leaves the bottle when the reservoir level drops enough to admit air to the bottle. As shown in FIGS. 1 and 2, the water transfer assembly 1 of the invention is in place on the reservoir instead of an inverted water bottle. The water bottle 3 is upright below the reservoir. It may be beside the cooler or inside the cooler as desired.

A closure or stopper 18 hermetically seals the neck 19 of the bottle. A long flexible water pipe 15 has a first opening 16 at or near the bottom of the bottle. The pipe 15 passes through closure 18 through the lateral wall 31 of the housing and has a second terminus at the bottom 30 of the housing to deposit water into the reservoir 5. Water is forced up through pips 15 only when air pressure builds up in the bottle through end 14 of air tube 12 which also passes through closure 18, and through lateral wall 31 of housing 4, and into the housing where it is connected to the pressure outlet 11 of air pump 8. A filter 26 may be provided at air inlet 10 to reduce contamination of the air pressure system 7. The pump may be one of the very low power, low cost pumps used for home aquaria that may be operated continuously from power cord 9. A float 25 connected to lever assembly 20 below the bottom 30 of the housing operates as a liquid level sensor operatively connected to bleeder valve 21 interposed in the air pressure system 7 to open the system to atmospheric pressure when the water in reservoir 5 reaches a predetermined level. This reduces the pressure in the bottle, stopping the flow in water pipe 15. When the level drops sufficiently in the reservoir, the float will drop, valve 21 will close, and pressure will once again build up in tube 12 and bottle 3, restoring water flow. By using a simple low cost, low pressure pump, there is no need for a pressure limiting device and the cost of running the pump continuously is minimal. Enclosing the pump within the housing muffles the sound.

Figure 3:
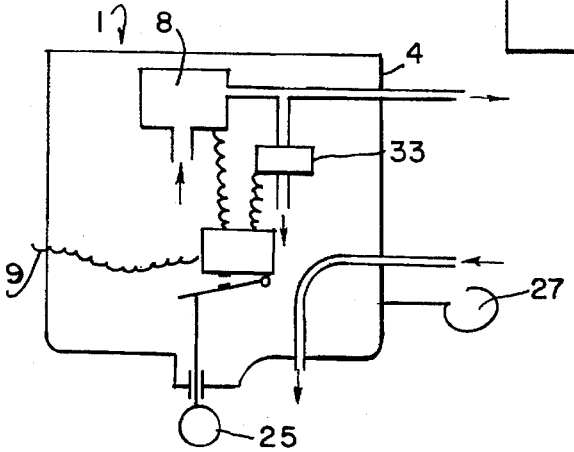
FIG. 3 is a diagrammatic view of a portion of another embodiment of the invention.

In the alternate embodiment illustrated in FIG. 3, the float 25 actuates an electric switch 23 which operates two circuits from power cord 9, energizing air pump 8 and closing bleed valve 33 so that the air pressure system is sealed from the atmosphere and pressure can build up therein whenever the level in the reservoir falls below a predetermined level.

To protect the portion of the device ordinarily within the bottle from contamination during bottle changing, a holder 27 for that purpose may be provided on the housing 4 so that the tubing will hang down in the air without touching anything. The same transfer assembly concept may alternatively be practiced using a water pump instead of an air pump to force the water from the bottle. This requires a more expensive pump and involves problems of priming the pump. Therefore the air pump is the preferred mode of practice of the invention.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. For a bottled water cooler having a cooled water reservoir with an open top adapted to support an inverted water container, a water transfer assembly for transferring water automatically from a non-inverted bottle of water having a constricted neck and positioned below said reservoir to the reservoir, the water transfer assembly comprising:

(A) a housing arranged to be installed on said reservoir in place of said inverted container by simply laying said housing on said reservoir;

(B) an air pressure system including an electrically powered air pump, said pump having an air inlet and a pressurized air outlet, said pump being contained within said housing;

(C) a closure for hermetically sealing the neck of said non-inverted bottle;

(D) an elongate, flexible tube means having two ends for fluid connection with said outlet at a first end and extending from said housing and through said closure and arranged for opening within said bottle at a second end for providing air pressure to said bottle for water transfer;

(E) an elongate, flexible water pipe means for transferring water from said bottle to said reservoir, said pipe means having a first terminus arranged to be at the bottom of said bottle, said pipe means extending from said first terminus, through said closure, and through said housing and arranged to deliver water from a second terminus to said reservoir; and (F) water level sensing means supported by said housing and disposed for sensing the level of water within said reservoir, said sensing means cooperating with said air pressure system to reduce air pressure within said bottle when water in said reservoir reaches a predetermined level.

2. The water transfer assembly according to claim 1, further comprising electric switch means operatively interconnected between said sensing means and said air pump for switching off said pump when water in said reservoir rises to a predetermined level and switching on said pump when water falls below a predetermined level.

3. The water transfer system according to claim 2, further comprising valve means interconnected between said sensing means and said tube means for opening said tube means to atmospheric pressure when water in said reservoir rises to a predetermined level and closing said tube means from atmospheric pressure when water in said reservoir falls below a predetermined level.

4. The water transfer system according to claim 1, further comprising valve means interconnected between said sensing means and said tube means for opening said tube means to atmospheric pressure when water in said reservoir rises to a predetermined level and closing said tube means from atmospheric pressure when water in said reservoir falls below a predetermined level.

5. The water transfer system according to claim 1, further comprising holding means attached to said housing for suspending said closure and elements dependent therefrom.

6. For a bottled water cooler having a cooled water reservoir with an open top adapted to support an inverted water container, a water transfer assembly for transferring water automatically from a non-inverted bottle of water having a constricted neck and positioned below said reservoir to the reservoir, the water transfer assembly comprising:

(A) a housing arranged to be installed on said reservoir in place of said inverted container by simply laying said housing on said reservoir;

(B) a fluid pressure system including an electrically powered fluid pump means contained within said housing for forcing water from said bottle into said reservoir;

(C) a closure for closing the neck of said non-inverted bottle;

(D) an elongate, flexible water pipe means for transferring water from said bottle to said reservoir, said pipe means having a first terminus arranged to be at the bottom of said bottle, said pipe means extending from said first terminus, through said closure, and through said housing and arranged to deliver water from a second terminus to said reservoir from forces generated by said pump means; and (E) water level sensing means supported by said housing and disposed for sensing the level of water within said reservoir, said sensing means cooperating with said fluid pressure system to force water from said bottle when water in said reservoir reaches a predetermined level.

7. The water transfer assembly according to claim 6, further comprising electric switch means operatively interconnected between said sensing means and said fluid pump means for switching off said pump means when water in said reservoir rises to a predetermined level and switching on said pump means when water falls below a predetermined level.

8. For a bottled water cooler having a cooled water reservoir with an open top adapted to support an inverted water container, a water transfer assembly for transferring water automatically from a non-inverted bottle of water having a constricted neck and positioned below said reservoir to the reservoir, the water transfer assembly comprising:

(A) a housing arranged to be installed on said reservoir in place of said inverted container by simply laying said housing on said reservoir; said housing having a top portion, a bottom portion, and lateral wall means for joining said top and bottom to define an interior chamber;

(B) an air pressure system including an electrically powered air pump, said pump having an air inlet and a pressurized air outlet, said pump being contained within said chamber;

(C) a closure for hermetically sealing the neck of said non-inverted bottle;

(D) an elongate, flexible tube means having two ends for fluid connection with said outlet at a first end and extending from said housing through said lateral wall means and through said closure and arranged for opening within said bottle at a second end for providing air pressure to said bottle for water transfer;

(E) an elongate, flexible water pipe means for transferring water from said bottle to said reservoir, said pipe means having a first terminus arranged to be at the bottom of said bottle, said pipe means extending from said first terminus, through said closure, and through said chamber and arranged to deliver water downward from said bottom portion from a second terminus to said reservoir; and (F) water level sensing means supported by said housing and disposed for sensing the level of water within said reservoir, said sensing means cooperating with said air pressure system to reduce air pressure within said bottle when water in said reservoir reaches a predetermined level.

* * * * *